US007261610B2

(12) United States Patent
Hitzschke et al.

(10) Patent No.: US 7,261,610 B2
(45) Date of Patent: Aug. 28, 2007

(54) METHOD FOR PRODUCING A GAS DISCHARGE VESSEL AT SUPERATMOSPHERIC PRESSURE

(75) Inventors: Lothar Hitzschke, München (DE); Frank Vollkommer, Buchendorf (DE)

(73) Assignee: Patent-Treuhand-Gesellschaft fuer Elektrische Gluehlampen, Munich (DE)

( * ) Notice: Subject to any disclaimer, the term of this patent is extended or adjusted under 35 U.S.C. 154(b) by 393 days.

(21) Appl. No.: 10/516,680

(22) PCT Filed: May 22, 2003

(86) PCT No.: PCT/DE03/01655

§ 371 (c)(1),
(2), (4) Date: Dec. 6, 2004

(87) PCT Pub. No.: WO03/105178

PCT Pub. Date: Dec. 18, 2003

(65) Prior Publication Data

US 2006/0025033 A1 Feb. 2, 2006

(30) Foreign Application Priority Data

Jun. 7, 2002 (DE) ..... 102 25 612

(51) Int. Cl.
*H01J 9/00* (2006.01)

(52) U.S. Cl. ..... 445/24; 445/43

(58) Field of Classification Search ..... 445/26, 445/40, 43, 41

See application file for complete search history.

(56) References Cited

U.S. PATENT DOCUMENTS

| | | | | |
|---|---|---|---|---|
| 3,914,000 | A | 10/1975 | Beckerman et al. | |
| 4,383,723 | A * | 5/1983 | Schleimann-Jensen | 445/54 |
| 4,414,460 | A | 11/1983 | Sudo et al. | |
| 6,657,392 | B2 | 12/2003 | Hitzschke et al. | |
| 6,762,549 | B2 | 7/2004 | Hitzschke et al. | |
| 6,837,767 | B2 * | 1/2005 | Hitzschke et al. | 445/26 |

FOREIGN PATENT DOCUMENTS

| | | |
|---|---|---|
| DE | 100 48 186 | 11/2002 |
| DE | 100 48 187 | 11/2002 |
| EP | 0 374 676 | 6/1990 |
| GB | 1 298 397 | 11/1972 |

* cited by examiner

*Primary Examiner*—Joseph Williams
(74) *Attorney, Agent, or Firm*—Robert F. Clark

(57) ABSTRACT

The invention relates to a novel method for producing gas discharge devices, in particular discharge lamps or plasma display units, in which discharge vessels are purged in a chamber with the required gas filling at superatmospheric pressure.

9 Claims, 2 Drawing Sheets

METHOD FOR PRODUCING A GAS DISCHARGE VESSEL AT SUPERATMOSPHERIC PRESSURE

TECHNICAL FIELD

The present invention relates to a method for producing a gas discharge device, in particular a discharge lamp or a plasma display unit (PDP). Gas discharge devices generally have a discharge vessel for holding a gaseous discharge medium. A method for producing gas discharge devices therefore necessarily includes the step of filling the discharge vessel with a gas filling and sealing the discharge vessel.

It is assumed in this description that the gas discharge device, for example the discharge lamp, is at least largely finished after the sealing, for which reason the method of production is regarded with the sealing of a discharge vessel as having been concluded, at least in essence. Of course, this does not exclude the essentially finished discharge lamp from being further provided with electrodes, coated with reflective layers, connected to mounting devices or being further processed in another way after the sealing of the discharge vessel. The method of production in the sense of the claims is intended, however, to be regarded as already implemented with the sealing of the discharge vessel.

PRIOR ART

As a rule, discharge vessels of discharge lamps or plasma display units are fitted with exhaust tubes or other connections, via which the discharge vessels can be evacuated and filled with the gas filling. These connections are generally sealed by fusing, whereupon projecting parts can be broken off or cut off.

The invention is directed in particular to gas discharge devices designed for dielectrically impeded discharges, and chiefly, in this case, to so-called flat radiators and also to plasma display units. Both in flat radiators and in plasma display units, the discharge vessel is designed to be flat and of relatively large size by comparison with the thickness and has two substantially plane-parallel plates. The manufacturing technologies, in so far, have common features. The plates need not, of course, be flat in the strict sense of the word, but can also be structured. Flat radiators are of interest, particularly for the backlighting of displays and monitors in liquid crystal technology (LCD). By contrast with LCDs, plasma display units require no backlighting, since they are self-luminous owing to the generation of light by the gas discharge. Plasma display units have recently come into use in TV sets, inter alia.

Also known in the technical field of flat radiators and plasma display units are methods of production in which the discharge vessel is evacuated and filled in a so-called vacuum furnace. The vacuum furnace is in this case a chamber which can be evacuated and heated. As in the case of conventional exhaust tube solutions as well, the exhaustion removes undesired gases and adsorbates, in order to keep the gas filling of the finished discharge lamp as pure as possible.

Exhaust tube solutions and comparable procedures are associated with restrictions on the discharge vessel geometry. Methods in the vacuum furnace are cost-intensive owing to the technical outlay for the vacuum furnace, and otherwise comparatively time-consuming.

SUMMARY OF THE INVENTION

The invention is based on the problem of specifying a method for producing a gas discharge device, in particular a discharge lamp and a plasma display unit, which is improved with regard to the step of filling and sealing the discharge vessel.

The invention is directed to a method for producing a gas discharge device, in particular a discharge lamp or a plasma display unit, in which a discharge vessel of the gas discharge device is filled with a gas filling and then sealed, characterized in that the filling and sealing of the discharge vessel are performed in a chamber which is purged with the gas filling at super-atmospheric pressure.

The invention proceeds from the finding that filling and sealing steps carried out in appropriately configured chambers are to be preferred to solutions with exhaust tubes or similar devices. They offer, in particular, the possibility of simultaneously processing relatively large numbers of discharge vessel units. Again, there are no boundary conditions for a discharge vessel design optimized in relation to the pumping and filling step through an exhaust tube connection, and to the sealing of the exhaust tube connection. Instead, the configuration of the discharge vessel is largely a matter of free choice and need only ensure manipulation of the discharge vessel parts which are to be interconnected for the purpose of sealing, or the steps otherwise required for sealing.

On the other hand, the inventors assume that a vacuum furnace signifies an outlay which is unnecessary with regard both to the costs of apparatus and to the processing times.

Instead, use is to be made according to the invention of a chamber in which the gas filling for the discharge vessel is present at superatmospheric pressure. Thus, the chamber need not be evacuable. Instead, undesired residual gases are removed by purging the chamber. Owing to the elimination of the high-vacuum-tight-sealing of the furnace and the evacuation steps, the method of production is therefore rendered substantially cheaper and shortened.

Moreover, the aim is to reduce the thermal inertia of the chamber and, in particular, of the chamber walls and not to design the latter to be too thick. This can be achieved by virtue of the fact that the superatmospheric pressure according to the invention is not too high. It is true that the invention also comprises embodiments in which this superatmospheric pressure is up to 1 bar, for example. However, it is preferred not to go over 300 mbar or, yet more favourably, not to go over 100 mbar.

The chamber walls are therefore preferably at most 8 mm, better at most 6 mm and at most 4 mm thick in the optimum case in the large surface portions. Profile structures can occur in this case, of course.

A favourable lower limit for the superatmospheric pressure is 10 mbar, and a preferred value of the lower limit is 50 mbar.

Furthermore, as already mentioned, the invention provides to purge the chamber with the gas filling. This purging can be performed by virtue of the fact that, owing to the simple design of the chamber, leaks present in any case or openings deliberately provided permit the corresponding gas atmosphere to flow out as a consequence of the superatmospheric pressure, and the said gas atmosphere is introduced into the chamber to maintain the superatmospheric pressure. An alternative consists in using an actual gas outlet line. However, in the case of the use of a gas outlet line, as well, the fact that the superatmospheric pressure leads to outflowing from possible leaks is to be regarded as a substantial advantage of the invention. In addition to the purging action, which is more favourable in any case given superatmospheric pressure, of a gas atmosphere for transporting away contaminants in the chamber, for example gases which have emerged from discharge vessel parts, there is thus a counteraction to the penetration of contaminants through openings in the chamber. This eliminates the need for complicated seals which increase the costs and can lead to additional inconvenience, for example when opening or closing the chamber.

It is preferably provided that the chamber can be heated, and so a furnace in the general sense is concerned. Owing to the heating, adsorbates and contaminants contained in specific constituents of the discharge vessel can be expelled and, in addition, other process steps can be initiated, as explained in further detail below. In particular, the heating can be necessary for the sealing of the discharge vessel. The chamber can preferably be heated entirely.

Also eliminated in this case are the requirements for heat-resistant seals which conventionally lead to technical problems and a corresponding outlay on time and costs. For example, the flat contact between simple sealing surfaces already suffices for a sufficient tightness, since remaining leaks are not a problem owing to the internal superatmospheric pressure in the chamber. However, within the scope of the invention, the chamber can also be open in the actual sense, that is to say it can permit the atmosphere to flow out inside the chamber not only through leaks, but through actual outlet openings. It has already been established that such an outlet opening can also consist, in particular, of a gas outlet line.

In order to shorten the process times, it can also be desirable to be able not only to heat the chamber up quickly, but also to cool it down quickly. A low thermal inertia targeted for the chamber by the invention is a first point of view in this case. Otherwise, the chamber can also be force-cooled. Consideration is preferably given in this case to bringing a cooling block into contact with the chamber so as to eliminate actually leading a cooling medium through the chamber itself. The cooling block can be water-cooled, for example. Since it is not itself heated to the high process temperatures of the chamber, there is no problem with the water cooling in this case. The cooling block can cool the chamber quickly and easily owing to the flat contact at the chamber.

In order to expel organic contaminants, for example binder materials in so-called solder glass or phosphor layers and reflective layers, it can be advantageous to heat up the discharge vessel before the filling in an oxygen-containing atmosphere, for example in air. Here, this atmosphere can be kept permanently flowing in order to transport the expelled contaminants away.

Furthermore, the discharge vessel can be purged with an inert gas before the filling and, if appropriate, after the heating in the oxygen-containing environment. Moreover, in addition to the actual discharge gas, that is to say the gas whose light emission is utilized technically in the discharge (a discharge gas mixture also being possible), during the filling the gas mixture can also include further gases, in particular inert gases. The discharge gas is preferably Xe. The added inert gas can be Ne and/or He, for example. In particular, in addition to the discharge gas it is possible for another gas to be present which exhibits a Penning effect relative to the discharge gas, that is to say promotes an ionization of the discharge gas via its own excitation. This holds for Ne in the case of the discharge gas Xe. Furthermore, a buffer gas can be added which serves the purpose of obtaining a desired overall pressure during the filling and in the finished, cooled discharge lamp in conjunction with a prescribed targeted partial pressure of the discharge gas and, if appropriate, the Penning gas. In this case, the partial pressures and the overall pressure must always be set during the filling such that they attain the targeted values in the case of the expected operating temperatures of the discharge lamp. Partial pressures (referred to room temperature) of 60-350 mbar, preferably 70-210 mbar and, with particular preference, 80-160 mbar are preferably to be selected for the discharge gas Xe.

Furthermore, it can be provided to connect an inert gas freezer and/or collector, for example at the gas outlet line, to the chamber in which a gas filling including inert gases is used for the filling, in order to be able to reuse at least a portion of the costly inert gases. In order not to have to design the inert gas freezer unit to be too large, or in order to limit the use of inert gas in the event of absence of such a freezer unit, the inert gas flow can be cut off immediately after the sealing of the discharge vessel. It is also possible in this case to switch over to another gas atmosphere or gas current which is more cost-effective. This is preferably air.

Overall, in order to minimize mechanical stresses and for the purpose of as uniform a temperature distribution as possible and accurate temperature control, the gases flowing into the chamber should be substantially at the discharge vessel temperature present at this instant. This means that the deviations in the temperatures should, as far as possible, be not greater than +/−100 K, preferably not greater than +/−50 K, depending on the actual discharge vessel temperature.

In particular, in this case the gases can be led through a gas inlet line brought to the chamber temperature over a lengthy section. This gas inlet line can, for example, be bored or milled into a solid part of the chamber and have an appropriate shape, for example a meandering shape, for the purpose of lengthening.

In the case of this invention, preference is given to a particularly simple embodiment in which the required method steps for heating, purging, filling and sealing the discharge vessel take place in one and the same chamber. The latter need not even necessarily contain a conveyor. It is preferably also not operated continuously, but loaded and emptied in charges.

Thus, it can be necessary in the case of such chambers, as in the case of a vacuum furnace, to separate chamber parts from one another in order to charge and to empty the chamber interior. In this case, the regions of the chamber parts which come to bear against one another with the chamber closed are preferably provided with a vacuum channel via which this bearing surface can be exhausted when opening and sealing the chamber. This exhaustion serves, firstly, to keep contaminants out of the chamber interior (in a way comparable to a vacuum cleaner), while it is thereby possible, secondly, to press one chamber part against the other and, thirdly, an effective sealing function can thereby be obtained. Specifically, the vacuum channel withdraws contaminants which could penetrate from outside before they reach the chamber interior. On the other hand, it produces a countercurrent of the gas present in the chamber interior at superatmospheric pressure, which furthermore prevents the penetration of contaminants. The vacuum channel can likewise be connected for this purpose to an inert gas collector or freezer.

BRIEF DESCRIPTION OF THE DRAWINGS

An exemplary embodiment is described below in detail with the aid of the attached drawings. Disclosed individual features can also be essential to the invention in this case in other combinations.

PREFERRED DESIGN OF THE INVENTION

Figure 1:
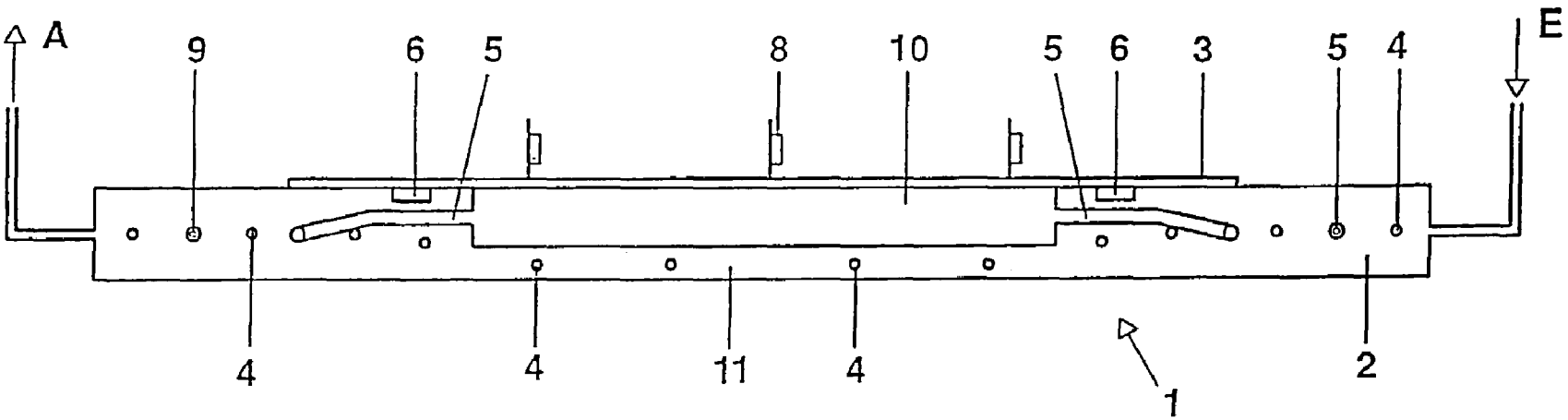
FIG. 1 shows a schematic sectional view through a plant for producing a discharge lamp or a plasma display unit with the aid of the method according to the invention.
Figure 2:
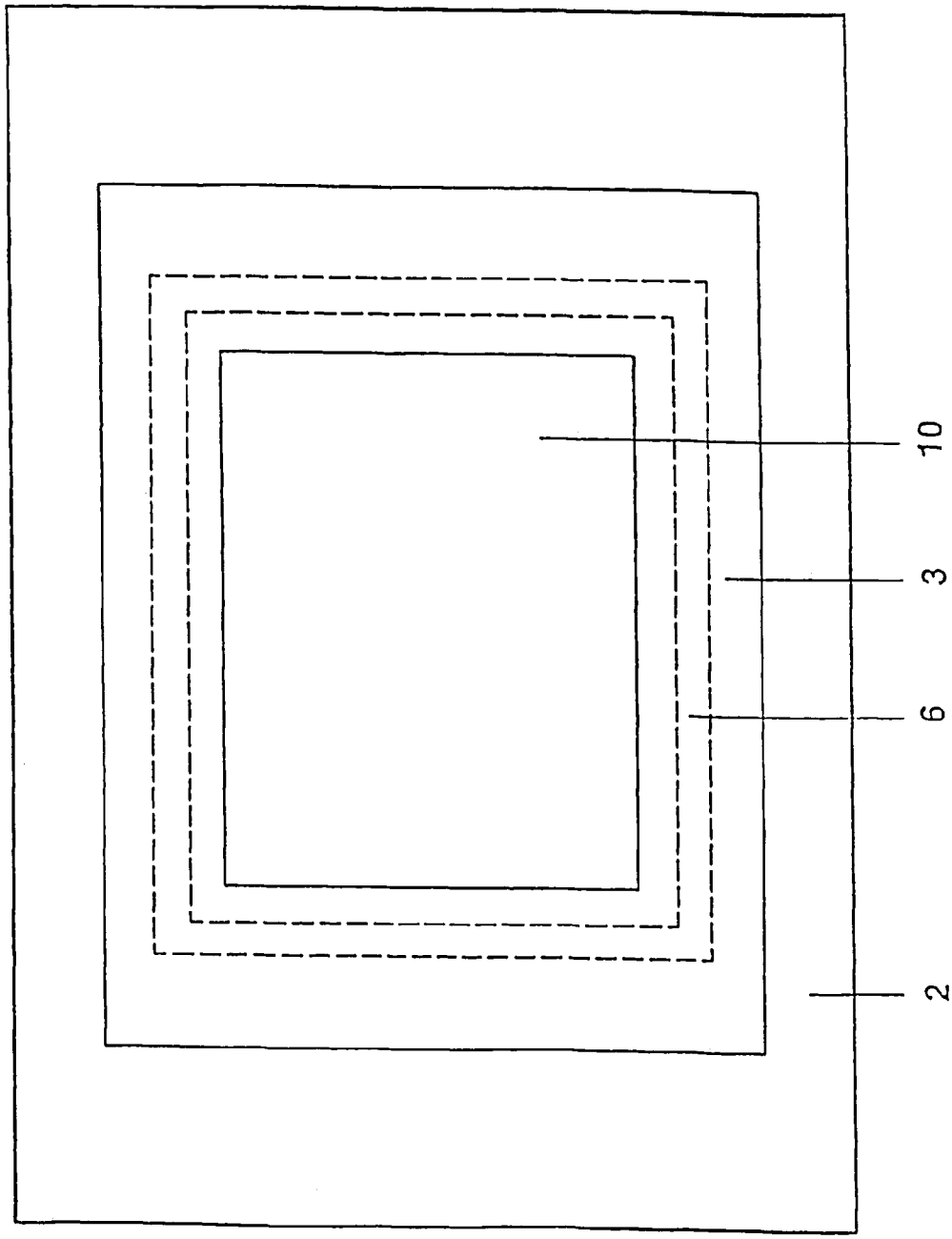
FIG. 2 shows a schematic plan view of the plant from FIG. 1.

FIG. 1 shows the plant according to the invention in a sectional view. The plant 1 illustrated there is of essentially flat design and corresponds in orientation to the flatness of the flat radiator discharge lamps or plasma display units to be produced, which are to be arranged in an internal space 10 in a metal block 2. No flat radiator discharge lamp or plasma display unit is drawn in, but what are involved here are, for example, flat radiators which are known per se and designed for dielectrically impeded discharges, and whose discharge vessel substantially comprises a cover plate and a baseplate which are interconnected at an edge. Arranged in or on the discharge vessel are electrodes which are separated at least partially by a dielectric from the discharge space in the discharge lamp. Reference is made to the following earlier patent applications from the same applicant as regards the structural details: US-A 2002/163311 and US-A 2002/163296. All that is important for the present context is that the discharge vessels are filled with a gas filling as discharge medium during the production, and then sealed.

For this purpose, the discharge lamps are brought individually or in a small number of items into the chamber 10 in the plant 1 from FIG. 1, a flat metal cover 3 being raised over the chamber 10. Interposed in this case between the baseplate and the cover plate of each discharge lamp are SF6 glass pieces which create a sufficient spacing between the two plates such that the discharge space in the respective discharge vessels communicates with the space 10.

The metal cover 3 is then mounted and thus seals the chamber 10 from the outside. The cover 3 can be sucked on via a vacuum channel 6, which is illustrated in section and opens towards the cover 3, and held firmly on the metal block 2.

The underside of the metal block 2 below the chamber 10 is a relatively thin metal wall 11 with a thickness of 3.5 mm. It is drawn in somewhat thicker in FIG. 1 in order to illustrate the heating device to be further explained later. The metal cover 3 has a thickness of approximately 2 mm. As a result, the chamber 10 is bounded over the greatest part of its outer surfaces by thin-walled parts of the plant.

The metal block 2 can be heated as a whole, including in the region of the thin wall 11 below the chamber 10, via an electric heater 4 illustrated in section, only a low thermal inertia resulting in the region of the thin walls. The cover 3 can, in turn, be heated via a heater 8 indicated symbolically.

Furthermore, it is possible to introduce into the chamber 10 via a gas line 5 and an inlet E a gas which can leave the chamber 10 again via a line 9 and an outlet A. The chamber 10 can thus be purged via the lines 5 and 9. Here, the lines meander in each case in the metal block 2, as indicated by the respectively doubled section through the line 5 and through the line 9, such that the length of the line is increased inside the metal block, and the gas flows in a preheated fashion into the chamber 10 and leaves the chamber again against a certain flow resistance within the line 9. This flow resistance can be generated by a suitably dimensioned cross section of the line 9, or else by a deliberately introduced obstacle (restrictor). The aim is thus to form a dynamic pressure in the chamber 10 during purging.

The outlet A is connected to an inert gas freezer in order to be able to recover the inert gases used for the gas filling.

It is thereby possible overall for the chamber to be heated, firstly purged in an oxygen-containing atmosphere, specifically dry air, then purged throughout with an inert gas, specifically argon, and finally purged at a superatmospheric pressure of 250 mbar with a mixture of He, Ne and Xe. Ne serves here as Penning gas and buffer gas, He only as buffer gas. In this case, the temperature in the chamber 10 rises to a temperature of approximately 500° C., such that the abovementioned SF6 pieces therefore soften and the cover plate supported by them sinks and is mounted on the baseplate. Already provided there is a solder glass (type 10045 from the manufacturer Ferro) which is so soft at this temperature that a tight bonded connection is produced between the two plates of the discharge vessel.

The inert gas flow can now be cut off, and a switchover can now be made to dry air for cooling down.

In order to accelerate the cooling down, a water-cooled cooling block (not depicted) can be brought into flat contact with the underside of the metal block 2 in order to cool the latter down quickly by thermal conduction. As a consequence of the flat geometry of the metal block 2 and, in particular, the thinness of the wall 11 and of the cover 3, the temperature in the chamber 10 drops relatively quickly. Consequently, the discharge lamp in the chamber 10, or the plurality of discharge lamps contained therein, can be quickly removed again. The production is therefore performed in charges.

While the cover 3 is resting on the chamber 10, it is held in the chamber 10 against the superatmospheric pressure via the vacuum in the vacuum channel 6 and could, if this does not suffice, be fastened overmore via mechanical clamps or by being weighted. The superatmospheric pressure in the chamber 10 leads to a lasting slight outflow of the gas atmosphere from the chamber 10 through the not completely tight plant surfaces between the cover 3 and the metal block 2 as far as into the vacuum channel 6. At the same time, the vacuum channel 6 exhausts contaminants entering from outside such that these cannot reach the chamber 10. The combination of the purging operation in the chamber 10, on the one hand, and the superatmospheric pressure driving contaminants outwards, on the other hand, thus ensures a quick and thorough production of the required gas purity in the chamber 10. The vacuum channel 6 therefore forms a sealing device, a seal and a contaminant barrier.

Since there is a certain gas consumption in any case because of the chamber volume and the production in charges, no substantial role is played by the loss through the flowing out of the gas along the sealing surfaces between the cover 3 and the metal block 2.

Otherwise, this region can also be exhausted and connected to the inert gas extraction unit if this is economically sensible.

The chamber 10 can accommodate a 21" lamp (of 42.7 cm×32 cm), for example. It then has internal dimensions of approximately 50 cm×40 cm×5 cm. The vacuum channel 6 can be 10 mm wide and 4 mm deep, for example.

Although the invention has been explained in detail in the exemplary embodiment above with the aid of a flat radiator, the invention is not limited thereto. Rather, the advantageous effects of the invention can also be achieved in the case of other types of discharge lamps and, in particular, also in the case of plasma display units.

The invention claimed is:

1. Method for producing a gas discharge vessel, comprising:

(a) placing a gas discharge vessel to be filled with a gas filling in a chamber, the chamber having an inlet and an outlet;

(b) sealing the chamber, introducing the gas filling into the chamber, the gas filling entering the chamber through the inlet and exiting the chamber through the outlet;

(c) purging the chamber with the gas filling at superatmospheric pressure;

(d) continuing purging the chamber with the gas filling at superatmospheric pressure while heating the chamber to seal the discharge vessel;

(e) stopping the purging of the chamber once the discharge vessel is sealed; and (f) cooling the chamber.

2. The method of claim 1 wherein the chamber is sealed via a vacuum channel which applies a vacuum to secure a metal cover.

3. The method of claim 1 wherein the outlet of the chamber is connected to an inert gas collector.

4. The method of claim 1 wherein after the discharge vessel is sealed, the chamber is purged with a gas which is less expensive than the gas filling.

5. The method of claim 1 wherein the gas filling contains a Xe discharge gas, a buffer gas, and an inert gas having a Penning effect with reference to the discharge gas.

6. The method of claim 5 wherein the gas filling contains a partial pressure of Xe in a range of 60-350 mbar at room temperature.

7. The method of claim 1 wherein the discharge vessel is heated in an oxygen-containing atmosphere in the chamber before purging with the gas filling.

8. The method of claim 7 wherein the discharge vessel is purged with an inert gas after heating in the oxygen-containing atmosphere and before purging with the gas filling.

9. The method of claim 1 wherein the chamber is cooled by contact with a water cooled block.

* * * * *